United States Patent [19]

Wokan et al.

[11] Patent Number: 4,993,383

[45] Date of Patent: Feb. 19, 1991

[54] CONTROLLER UNIT

[75] Inventors: Andreas Wokan, Darmstadt; Gerald Helmstädter, Weiterstadt; Kurt Probst, Schwalbach, all of Fed. Rep. of Germany

[73] Assignee: VDO Adolf Schindling AG, Frankfurt am Main, Fed. Rep. of Germany

[21] Appl. No.: 216,940

[22] Filed: Jul. 8, 1988

[30] Foreign Application Priority Data

Jul. 8, 1987 [DE] Fed. Rep. of Germany ..... 3722528

[51] Int. Cl.[5] ..... F02D 11/10

[52] U.S. Cl. ..... 123/399; 123/339

[58] Field of Search ..... 123/399

[56] References Cited

U.S. PATENT DOCUMENTS

| | | | |
|---|---|---|---|
| 4,506,642 | 3/1985 | Pfalzgraf et al. | 123/399 |
| 4,622,936 | 11/1986 | Junginger et al. | 123/399 |
| 4,691,676 | 9/1987 | Kikuchi | 123/399 |
| 4,765,295 | 8/1988 | Ishikawa et al. | 123/399 |

OTHER PUBLICATIONS

Patent Abstracts of Japan, vol. 7, No. 79 (M-204) [1224], Mar. 31, 1983 & JP-A-58, 5452.

Patent Abstracts of Japan, vol. 8, No. 216 (M-329) [1653], Oct. 3, 1984 & JP-A-59, 101576.

Patent Abstracts of Japan, vol. 7, No. 287 (M-264) [1432], Dec. 21, 1983 & JP-A-58, 160531.

*Primary Examiner*—Andrew M. Dolinar

*Attorney, Agent, or Firm*—Martin A. Farber

[57] ABSTRACT

The controller unit (3) which is used in combination, for instance, with an electric gas pedal system which consists of a gas pedal (1), a desired-value transmitter (2), an electronic controller unit (3), a controlling element (4), a position reporter (5), a transmission device (6) and a displacement device (7) developed, for instance, as throttle valve, has associated with it, in addition to an additional control unit (8) for increasing the idle speed of rotation, an adjustment device (12) which detects the, in each case, highest end position set instantaneously by the additional control unit and feeds it as effective first desired-value end position into the controller unit.

3 Claims, 3 Drawing Sheets

L = LOAD
VL = FULL LOAD
SWG = DESIRED-VALUE TRANSMITTER (GAS PEDAL)
SGS = POSITION CONTROLLING ELEMENT

CONTROLLER UNIT

FIELD AND BACKGROUND OF THE INVENTION

The on relates to an automatic controller unit having a plurality of control functions for the controlling of a controlling element and for regulating its adjusted position as a function of at least two input variables, the controlling element serving in particular for regulating the engine output of an internal combustion engine.

Upon the use of controller unit of the above-indicated type in combination with an electric gas pedal, there is a fixed association between the pre-established value of the desired-value transmitter and the position of the controlling element results upon over-run control. If an additional control function which results in an increase in the idling speed of rotation is associated with such a controller unit because, for instance, an increase in speed of rotation is necessary as a function of the temperature of the engine at low temperatures or because, for instance, by the attachment of additional loads such as, for instance, an air conditioner, an increased output of the engine upon idling is necessary, then a plurality of correcting variables result only one of which can be evaluated by the controller unit, namely, referring to the present example, the highest correcting variable. From this there result idle paths and delay times for the other correcting variables the first end position of which is located at a given value. Thus, for example, an idle path from the first end position of the desired-value transmitter to the instantaneous adjustment value of the controlling element can occur on the desired-value transmitter actuated by the gas pedal. In the practical case, this has the result that the driver of an automotive vehicle first of all actuates the gas pedal without corresponding reaction on the controlling element since, as a result of the additional adjustment function the idling speed of rotation has been increased to a higher value. The gas pedal must then be actuated to such an extent that the desired value which is adjustable by the gas pedal reaches the instantaneous actual value of the controlling element. This leads to the undesired delay times mentioned further above, which, under certain circumstances, may bring about critical situations.

SUMMARY OF THE INVENTION

The objective of the present invention is to adapt the idling speed of rotation of an internal combustion engine to the instantaneous power requirements and in this connection at the same time to bring the distance of displacement of the power setting member (throttle valve or displacement distance of the control rod of an injection pump) and the available distance of the desired-value transmitter (the gas pedal) into a linear relationship with each other.

The background for this is as follows. If an internal combustion engine is operating in an automotive vehicle then the driver expects that upon a change in the position of the gas pedal the torque, the speed of rotation and thus also the power of the internal combustion engine will change accordingly. When the engine has warmed up this is generally also the case; the engine depends on the gas.

However, if the internal combustion engine is started cold, then the increased losses due to internal friction must be compensated for by an increased feeding of fuel in order that the engine does not stall. For this, a corresponding displacement of the fuel metering device (designated 11 in FIG. 2) is required if the adjustment of the idling speed operates on the same element as the gas pedal does.

It is an object of the invention to avoid the idle paths and delay times which result from a plurality of adjustment function ends which result, for instance, in an increase in the idling speed of rotation.

Accordingly, by the invention, starting from a controller unit of the aforementioned type, there is provided an adjusting device (12) by which the, in each case, highest first end position set instantaneously on basis of one of the control functions can be detected and stored as effective desired-value end position for remaining correcting variables in the controller unit (3).

By this formation, all first desired-value end positions in the controller unit are raised to the position raised by one of the additional controller functions and corresponding to the instantaneous actual value of the controlling element and thus continuously restandardized to the remaining adjustment region, from which, due to elimination of an idle path, a direct response and thus a short reaction time and a better resolution of the remaining setting region result.

BRIEF DESCRIPTION OF THE DRAWING

With the above and other objects and advantages in view, the present invention will become more clearly understood in connection with the detailed description of a preferred embodiment, when considered with the accompanying drawing, of which.

DETAILED DESCRIPTION OF THE PREFERRED EMBODIMENT

Figure 1:
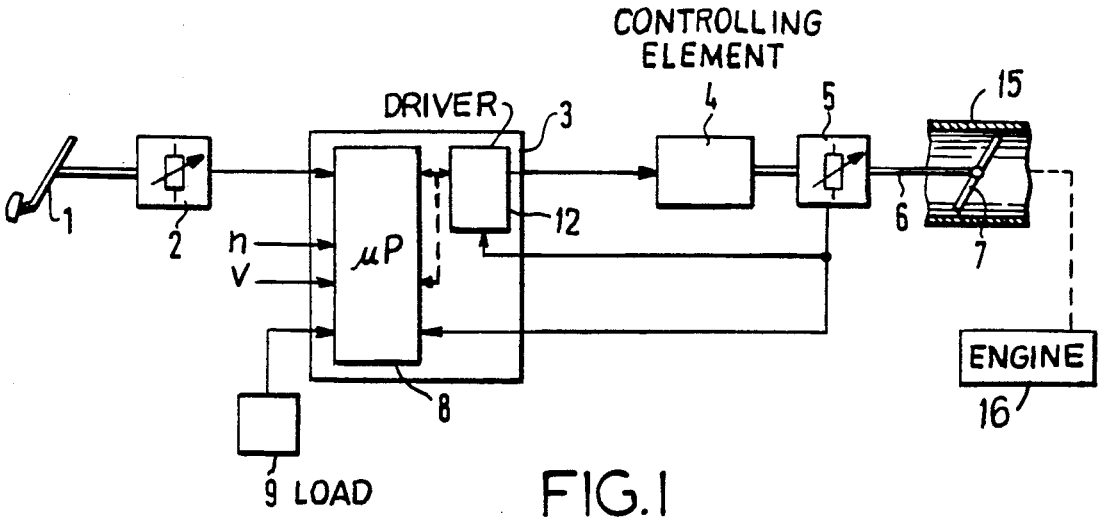
FIG. 1 is a block diagram of an electric gas pedal system.
Figure 2:
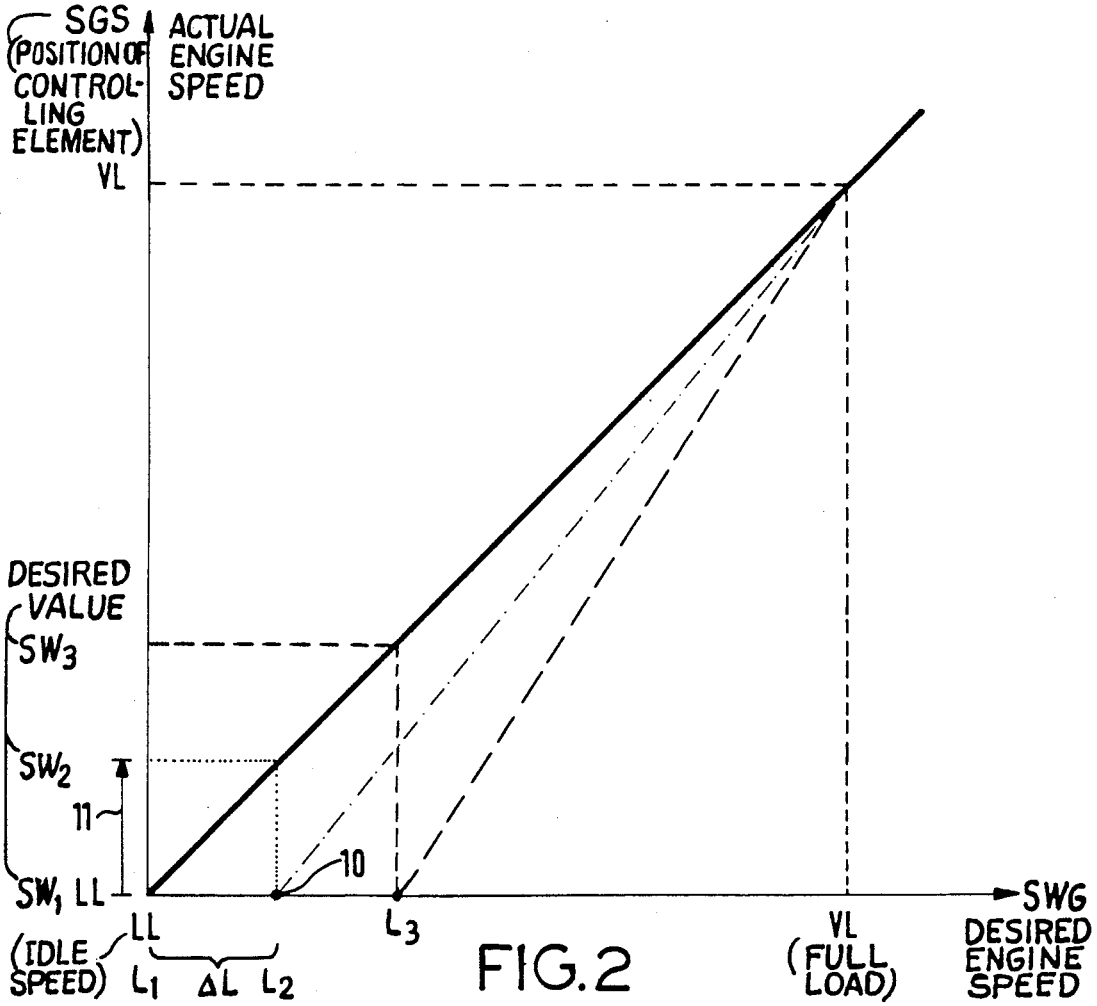
FIG. 2 is a graph of the adjustment range.

As can be noted from FIG. 1, an electric gas pedal system comprises a gas pedal 1, a desired-value transmitter 2, an electronic controller unit 3, a controlling element 4, a position reporter 5, a transmission unit 6 and a displacement or output unit 7 developed as a throttle valve, the latter being controllably disposed in the intake passage of a carburetor 15 of an engine 16. 9 is an electrc load, upon the placing in operation of which an increase in the idle speed of rotation is effected by a microprocessor 8. The actual idle control value setting which has thus been increased is designated 10 in the graph of FIG. 2. The graph of FIG. 2 shows the association of the position of the controlling element 4 inn relation to the position of the desired-value transmitter 2. The solid line shows the association of the known system while the dash-dot line shows an example of a new association in accordance with the invention.

Another example of an input variable which can lead to a change in the output variable of the controller unit is the speed of rotation, n, of the internal combustion engine or the speed, V, of the vehicle; these variables are indicated in FIG. 1 in the form of inputs of the speed of rotation n and the vehicular speed V to the microprocessor 8. A driver 12 of the controller unit 3 is responsive to the microprocessor 8 for outputting drive signals to activate the controlling element 4. The driver 12 operates as part of a feedback loop, the driver 12 including a differential input which compares a commanded position of the microprocessor 8 with a feedback position signal from the reporter 5.

In order now to exclude the idle path designated by the arrow 11 which results from the new adjustment of the instantaneous idling speed control value designated by point 10, the microprocessor 8 is responsive to the highest instantaneous idle control value by report from the position reporter 5. This instantaneous highest end position of the idle control value is then fixed as effective first desired-value end position for all remaining correcting variables. Thus for all desired-value indications as first end position, there results the point designated 10 in the graph of FIG. 2 and thus a new association of desired value and position of the controlling element 4 corresponding to the dot-dash line of FIG. 2. Upon this process, a second end position remains on its point determined by the controller unit 3.

In the case of a carburetor engine, the throttle valve is, for instance, opened further so that without any special measures, both in the event of mechanical and of electrical transmission of the position of the gas pedal to the throttle valve, the available path of displacement of the gas pedal is reduced. If the position of the controlling element 4 is shifted further in the direction of full load in order to maintain the desired speed of rotation, the gas pedal, when depressed, first of all moves through an idle path until the command "more fuel", so to speak, takes precedence over the previous command from the idle-speed regulator. Only then does an increase in torque and power take place. Diesel engines, in particular, may require 30% to 40% of the displacement path of the control rod of the injection pump in order to maintain idling in winter. The driver must therefore first of all depress the pedal by 30 to 40% of its path without action before a response of the engine is perceptible.

As a result of the constant slope of the solid line in the graph of FIG. 2, upon an increase in frictional losses of the cold engine, the engine reacts, sluggishly. An interposed speed governor such as the controller unit 3 acts in similar manner. Since the propulsion is adjusted by the throttle valve or the injection pump, the driver initially "steps into empty air" upon an attempt to increase the speed beyond that set. Only when he has brought the gas pedal into the position of the throttle valve which corresponds to the instantaneous demand for power and then exceeds it does the engine respond with an increase in power.

Another critical point arises when the vehicle is equipped with an air conditioning system having a compressor. The power requirement of the compressor generally makes a higher idling speed of rotation necessary (designated L3—Load 3—in FIG. 2), which presupposes a correspondingly increased feed of fuel. The controlling element 4 provided for this must therefore be even further in the direction towards full load (at SW3—desired value 3—in FIG. 2). Here is where the present invention acts.

By the electric transmission of the position of the accelerator pedal as desired-value transmitter (SWG) to the controlling element 4 for the metering of the fuel, the possibility arises of associating the path of the controlling element remaining upon the increase of the idling speed of rotation, linearly with the entire path of the gas pedal. The accelerator pedal then has no idle path and the engine responds promptly with acceleration when the accelerator pedal is depressed. Furthermore, due to the steep or characteristic lines, it responds livelier (dot-dash curve from L2 (load 2) to VL (full load)) and dashed-line curve from L3 (load 3) from VL (full load).

Figure 3:
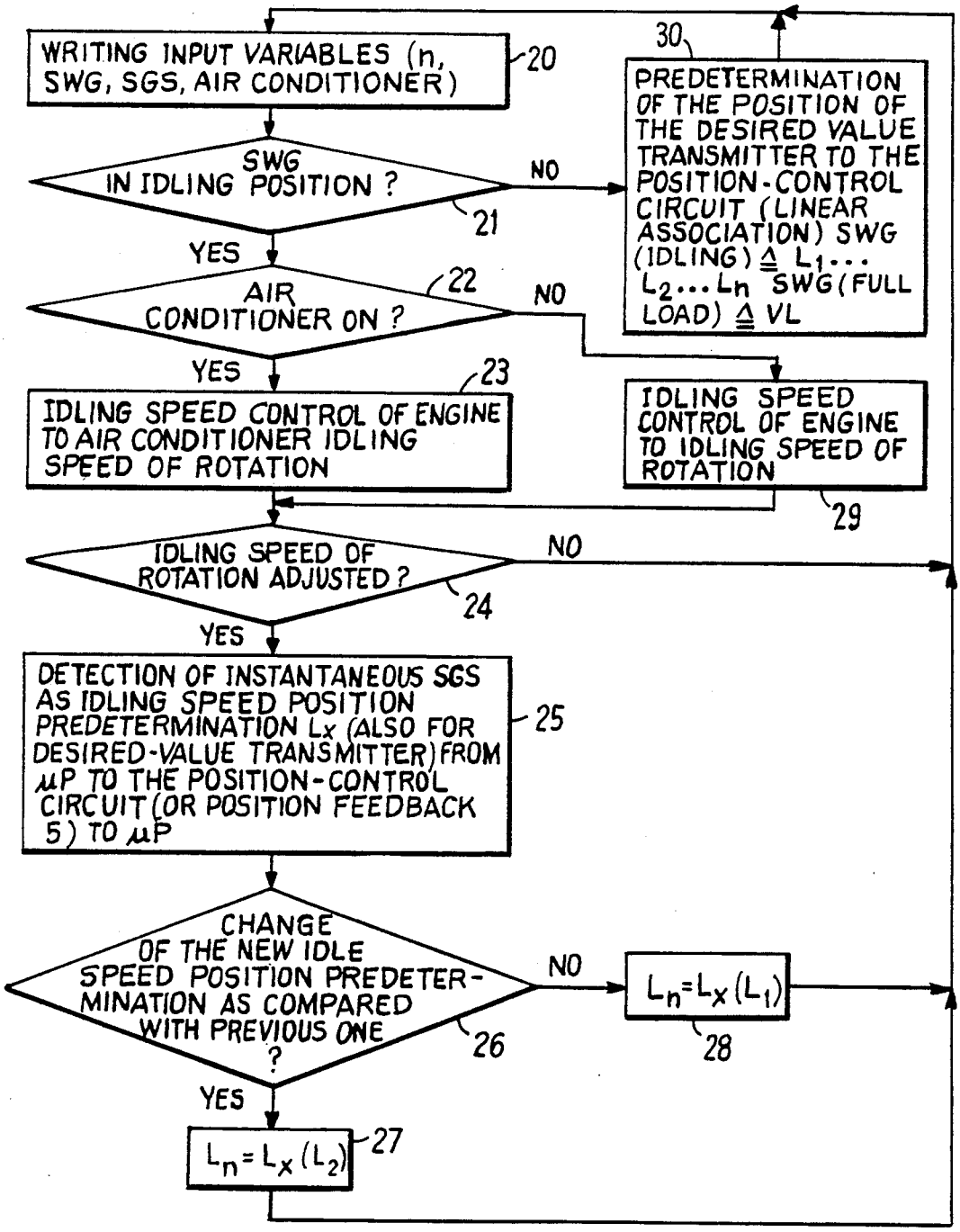
FIG. 3 is a flow chart of a controller unit of the system of FIG. 1.

The reduction to practice of this concept by means of the microprocessor-controlled governor namely, the controller unit 3, leads to an operating program such as shown in the flowchart of FIG. 3. With unchanged initial value of the idling speed of rotation the program always proceeds over the "small loop" (LX corresponds to L1) and upon a change in the initial value (for instance, turning on the air conditioning system) over the "large" loop (LX corresponds to L2).

Figure 4:
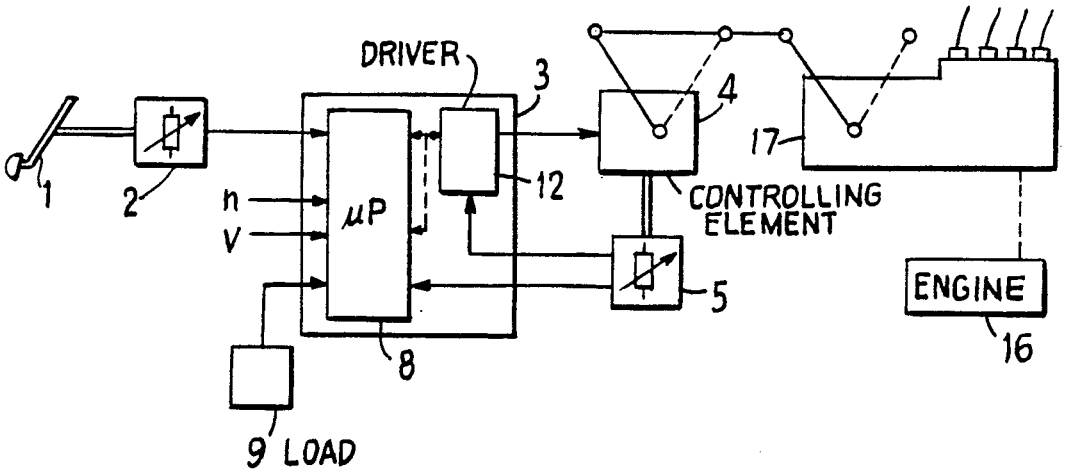
FIG. 4 is an alternative embodiment of the system of FIG. 1.

As shown in FIGS. 1 and 4, the controller unit 3 has in addition to the microprocessor unit 8, the driver 12 for the actuating of the controlling element 4, including a position-control circuit therein. The feedback of the position of the controlling element SGS either takes place here from a feedback potentiometer of the reporter 5 to the microprocessor 8, or else the microprocessor uses a position-control circuit predetermined value as measurement variable. In both cases a linear relationship is established between the position of the desired-value transmitter SWG and the position of the controlling element SGS. The system of FIG. 1 corresponds to the use of the invention in an internal combustion engine 16 with preparation of the mixture by carburetor 15, while the diagram of FIG. 4 corresponds to an internal combustion engine 16 with feeding of the fuel by an injection pump 17.

The flow chart of FIG. 3 depicts the following operation of the microprocessor 8. The operation begins by entering data, block 20, into the microprocessor, the data including the position SWG of the gas pedal 1 transmitted via the desired value transmitter 2, the status of the load 9, and the position of the controlling element 4 transmitted by the reporter 5. The data includes also the engine speed n which may be transmitted by an electronic tachometer (not shown) connected to the engine 16, and the vehicular speed V which may be transmitted to the microprocessor 8 by an electronic speedometer (not shown) of the vehicle.

Assuming now, by way of example, that the gas pedal is at idle position, block 21, and that the air conditioner (load 9), is on, block 22, the microprocessor orders the appropriate engine idle, n, to run the load 9 (air conditioner) at block 23. The microprocessor checks the engine speed at block 24, and if the idle speed has not been adequately adjusted, recycles through block 20–23 to direct further idle until the idle is correct. Then at blocks 25 and 26, the microprocessor sets up the relationship, depicted in FIG. 2, for the controlling element 4 with the load 9, air conditioner, running. At block 26, the microprocessor notes as to whether the previously established values for the relationship of FIG. 2 have changed, and proceeds via block 27 or 28 respectively to alter or retain the parameters of the relationship as may be required. The program then returns to an updating of data at block 20.

At block 22, if the air conditioner were off, the microprocessor proceeds via block 29 to set the idle accordingly for a no load condition. In the situation wherein the vehicle is being driven with the gas pedal depressed from idle, block 21, operation proceeds via block 30 to direct a position output of the controlling element 4 in accordance with the previously established relationship of FIG. 2. Thereby, the microprocessor operates in response to a command of the gas pedal by considering the previous history of how the engine responds under load, and on the basis of the running status of a load to give a linear response of engine speed to gas pedal position without delay or dead spot in the operation of the gas pedal.

We claim:

1. A control system comprising:

an automatic controller unit and a controlling element, the controller unit providing a plurality of control functions for controlling the controlling element and for regulating a position thereof as a function of at least two input variables, one of the input variables being the position of an accelerator pedal, the controlling element serving in particular for regulating engine output of an internal combustion engine;

a position reporter, the controlling element driving an output unit via the position reporter, the reporter outputting a signal indicating a position of the output unit; and wherein said controller unit comprises an adjusting device connected to an output of the reporter, the adjusting device outputting a control signal to the controlling element in response to the signal outputted by the reporter to establish a first end position set instantaneously on a basis of one of the control functions, the adjusting device detecting and storing a position of the output unit as effective desired-value end position for all remaining correcting variables in the controller unit, the controller unit employing the effective desired-value end position to offset a curved representing actual engine speed as a function of desired engine speed to linearize a relationship between defection of the accelerator pedal and engine speed for differing values of engine load.

2. A control system comprising:

an automatic controller unit and a controlling element, the controller unit providing a plurality of control functions for controlling the controlling element and for regulating a position thereof as a function of at least two input variables, the controlling element serving in particular for regulating engine output of an internal combustion engine, one of the input variables being the position of an accelerator pedal;

a position reporter, the controlling element driving an output unit via the position reporter, the reporter outputting a signal indicating a position of the output unit; and wherein said controller unit comprises an adjusting device connected to an output of the reporter, the adjusting device repetitively outputting a control signal to the controlling element in response to the signal outputted by the reporter to establish a current value of engine idle based on a current loading of the engine, the adjusting device repetitively detecting and storing a position of the output unit during idle to serve as effective desired-value position, the controller unit employing the effective desired-value end position to offset a curve representing actual engine speed as a function of desired engine speed to linearize a relationship between deflection of accelerator pedal and engine speed for differing values of engine load.

3. A control system comprising:

an automatic controller unit and a controlling element, the controller unit providing a plurality of control functions for controlling the controlling element and for regulating a position thereof as a function of at least two input variables, one of the input variables being the position of an accelerator pedal, the controlling element serving in particular for regulating engine output of an internal combustion engine;

a position reporter, the controlling element driving an output unit via the position reporter, the reporter outputting a signal indicating a position of the output unit; and wherein said controller unit comprises an adjusting device connected to an output of the reporter, the adjusting device being responsive to the signal outputted by the reporter to establish a value of engine idle based on a current loading of the engine, the adjusting device in cooperation with said reporter detecting and storing a position of the output unit providing said value of engine idle, said adjusting device employing said position of the output unit a s a reference point corresponding to an idle position of the accelerator pedal in a relationship between deflection of accelerator pedal and engine speed for the current engine loading.

* * * * *